US006067823A

United States Patent [19]

Östergren

[11] Patent Number: 6,067,823

[45] Date of Patent: May 30, 2000

[54] LOCK MECHANISM DEVICE

[76] Inventor: Arnold Östergren, Köpmanvägen, S-430 17 Skällinge, Sweden

[21] Appl. No.: 09/068,842

[22] PCT Filed: Nov. 28, 1996

[86] PCT No.: PCT/SE96/01520

§ 371 Date: Jul. 28, 1998

§ 102(e) Date: Jul. 28, 1998

[87] PCT Pub. No.: WO97/20122

PCT Pub. Date: Jun. 5, 1997

[30] Foreign Application Priority Data

Nov. 28, 1995 [SE] Sweden ..... 9504235

[51] Int. Cl.[7] ..... E05B 17/20; E05B 55/04

[52] U.S. Cl. ..... 70/210; 70/150; 70/467; 70/484; 292/173

[58] Field of Search ..... 70/141, 467, 469, 70/470, 471, 483–485, 489, 150, 224, 210, 211, 207; 292/165, 167, 173

[56] References Cited

U.S. PATENT DOCUMENTS

| | | | |
|---|---|---|---|
| 1,062,176 | 5/1913 | Mason | 70/467 |
| 1,554,839 | 9/1925 | Brown | 70/150 |
| 1,721,162 | 7/1929 | Moore | 70/150 |
| 1,855,089 | 4/1932 | Boothe | 70/483 |
| 2,240,524 | 5/1941 | Smith . | |
| 5,469,723 | 11/1995 | Litwin et al. | 70/107 |

FOREIGN PATENT DOCUMENTS

| | | | |
|---|---|---|---|
| 1158889 | 6/1958 | France | 70/110 |

*Primary Examiner*—Darnell M. Boucher
*Attorney, Agent, or Firm*—Dvorak & Orum

[57] ABSTRACT

The present invention relates to an arrangement for a locking mechanism comprising a lock bolt spring-assisted in the intended direction of locking, which is contained inside a lock casing connected to a plate capable of attachment along the side of a door. An actuating arm projects laterally form said lock bolt and capable of actuation by means of a handle connection extending through a door of the intended kind and a handle projecting on either side of the door. A pivoting follower acts between said handle and actuating arm for the purpose of actuating the actuating arm and the lock bolt. The arrangement has a lock component capable of being caused to move in a linear direction arranged in such a way as to be capable of displacement by means of a pivotally mounted lock component carrier. This is attached to a lock cylinder connected to any side/sides of the lock and the door in question and capable of being turned by means of a key, so as to be moved between a locking position for locking the actuating arm and an opening position for releasing the actuating arm. The lock component is capable of interacting for this purpose with a stop on the actuating arm in the locking position. A spring-assisted stop component is also capable of interacting with the lick component for the purpose of retaining it in the withdrawn opening position enabling the bolt to be displaced, and in the extended locking position for the purpose of retaining the bolt in the locking position through interaction with the lock component.

2 Claims, 4 Drawing Sheets

LOCK MECHANISM DEVICE

The present invention relates to an arrangement for a locking mechanism comprising a lock bolt spring-assisted in the intended direction of locking, which is contained inside a lock casing connected to a plate capable of attachment along the side of a door, and with an actuating arm projecting laterally from said lock bolt and capable of actuation by means of a handle connection extending through a door of the intended kind and a handle projecting on either side of the door, and with a pivoting follower acting between said handle and actuating arm for the purpose of actuating the actuating arm and the lock bolt, in conjunction with which a lock component capable of being caused to move in a linear direction is arranged in such a way as to be capable of displacement by means of a pivotally mounted lock component carrier, which is attached to a lock cylinder connected to any side/sides of the lock and the door in question and capable of being turned by means of a key, so as to be moved between a locking position in which the actuating arm is locked and an opening position in which the actuating arm is released, and in that the lock component is capable of interacting with a stop on the actuating arm in the locking position, in conjunction with which a spring-assisted stop component is capable of interacting with the lock component for the purpose of retaining it in the withdrawn opening position, enabling the bolt to be displaced, and in the extended locking position for the purpose of retaining the bolt in the locking position through interaction with the lock component.

A lock which is designed for installation on the outside of an intended door leaf has been in constant use for some time in so-called farm buildings such as cow sheds and stores, etc., where there was the need for a durable lock with high functional reliability. The advantages of such locks are many. In particular they are easy to install, and they require no major intervention in the existing door. Unlike locks which are recessed into the door leaf, any moist air is able to escape easily by ventilation, and these locks are thus less prone to freezing solid. Finally, thanks to the aforementioned features, these locks require very little maintenance; this maintenance is also easy to perform thanks to the ready accessibility of the lock components.

SE-C-140 664 shows a lock mechanism in accordance with the preamble to the claims. This arrangement is well proven in service and has been available on the market for more than 40 years. The situation encountered within society today is different, however, from that at the time when this lock was invented. In line with increased criminality, the need has also arisen for more thief-proof locks in farm buildings, too. The arrangement described in SE-C-140 664 also suffers from the disadvantage that it is perhaps believed, since the key of the lock functions both as a key and as an external door handle, that they key must be left in the lock at all times and that someone could happen to pull it out and, in the worst case, fall backwards and injure him/her self.

The principal object of the present invention is thus to overcome the disadvantages outlined above by simple but effective means.

A further object of the present invention is to make available a lock which, like the lock in accordance with SE-C-140 664, utilizes the handle, i.e. the door handle, to withdraw the lock bolt, instead of causing this transfer of force to take place via the key of the lock. In this way the risk is reduced of the key breaking off in the lock because of excessive torsional strain, for example if the lock bolt has unexpectedly frozen solid.

A lock arrangement previously disclosed in, amongst others, U.S. Pat. No. 1,554,839 is of a similar kind to that in accordance with the preamble to the present invention. No means are provided, however, to prevent a follower from sliding off a hook part in the actuating arm, either to the side, if the contact surfaces of the components attempt to slide out of engagement with one another, for example as the result of external force applied to the lock, or along the plane of the pivoting motion of the follower, if the follower runs the risk of sliding off the preferably straight hook part of the actuating arm as a consequence of excessive pivoting motion. This problem must also be solved.

Said objective is achieved by means of an arrangement in accordance with the present invention, which is characterized essentially in that a strap, which is attached to the door fixing plate, encloses a projecting pressure component on the follower and a hook component on the actuating arm, thereby forming a groove in which the components are guided in a lateral sense, which groove also restricts the pivoting motion of the follower and thus also the common inward and outward movement of the actuating arm and the bolt.

The invention is described below with reference to the accompanying drawings, in which.

Figure 1:
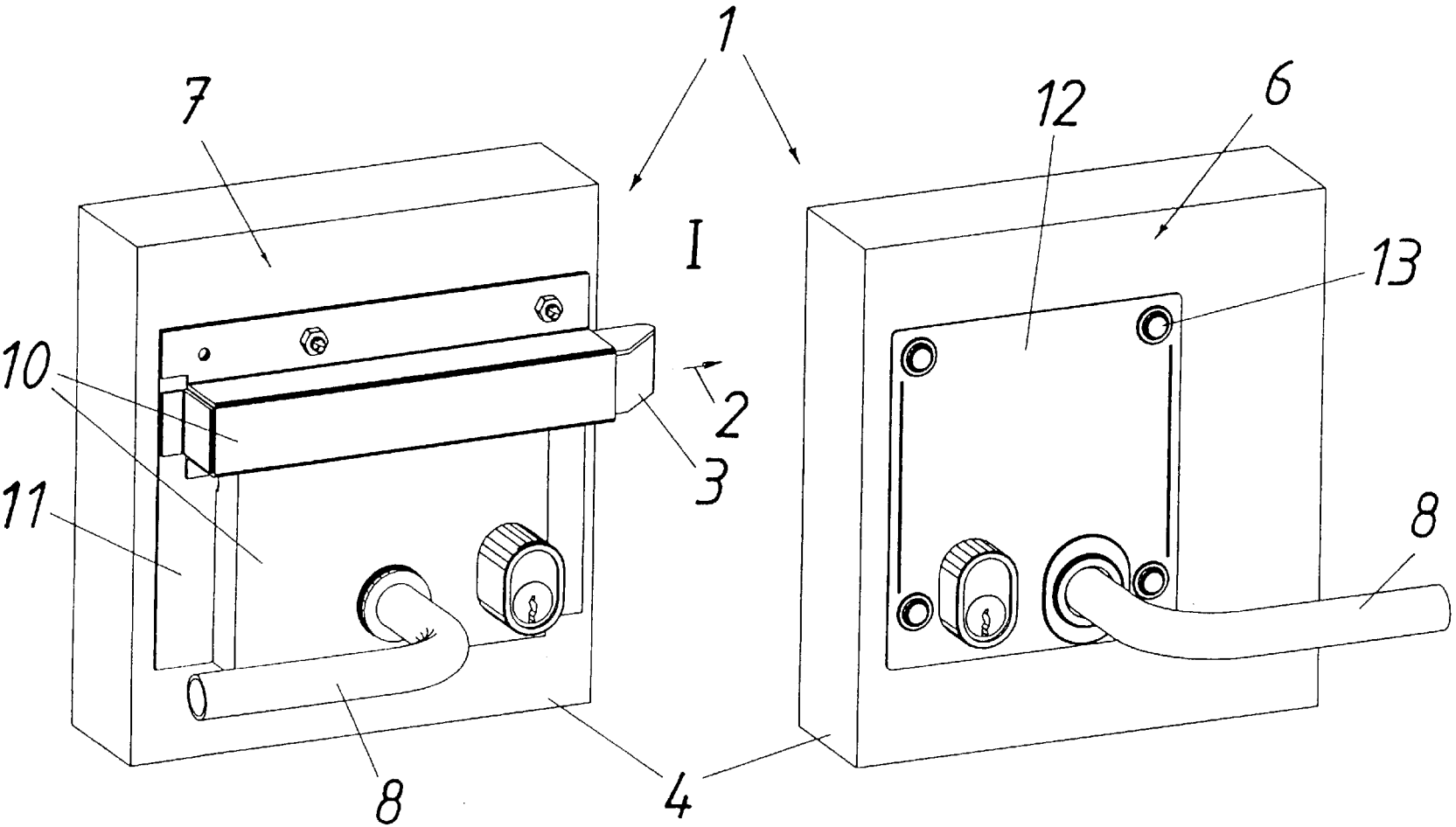
FIG. 1 shows an external component and an internal component of the lock installed on a door.
Figure 2:
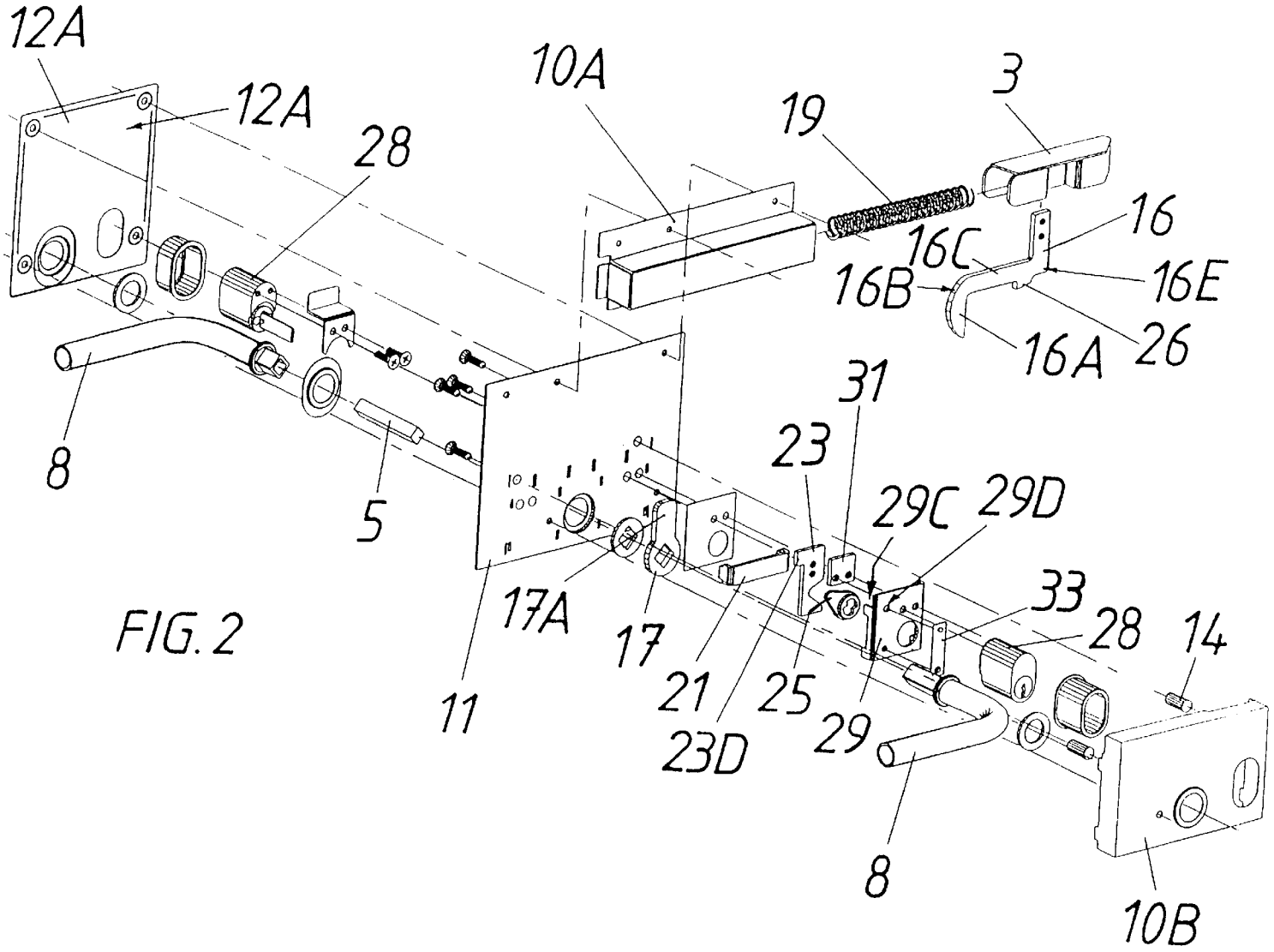
FIG. 2 shows the lock as an exploded drawing.
Figure 3:
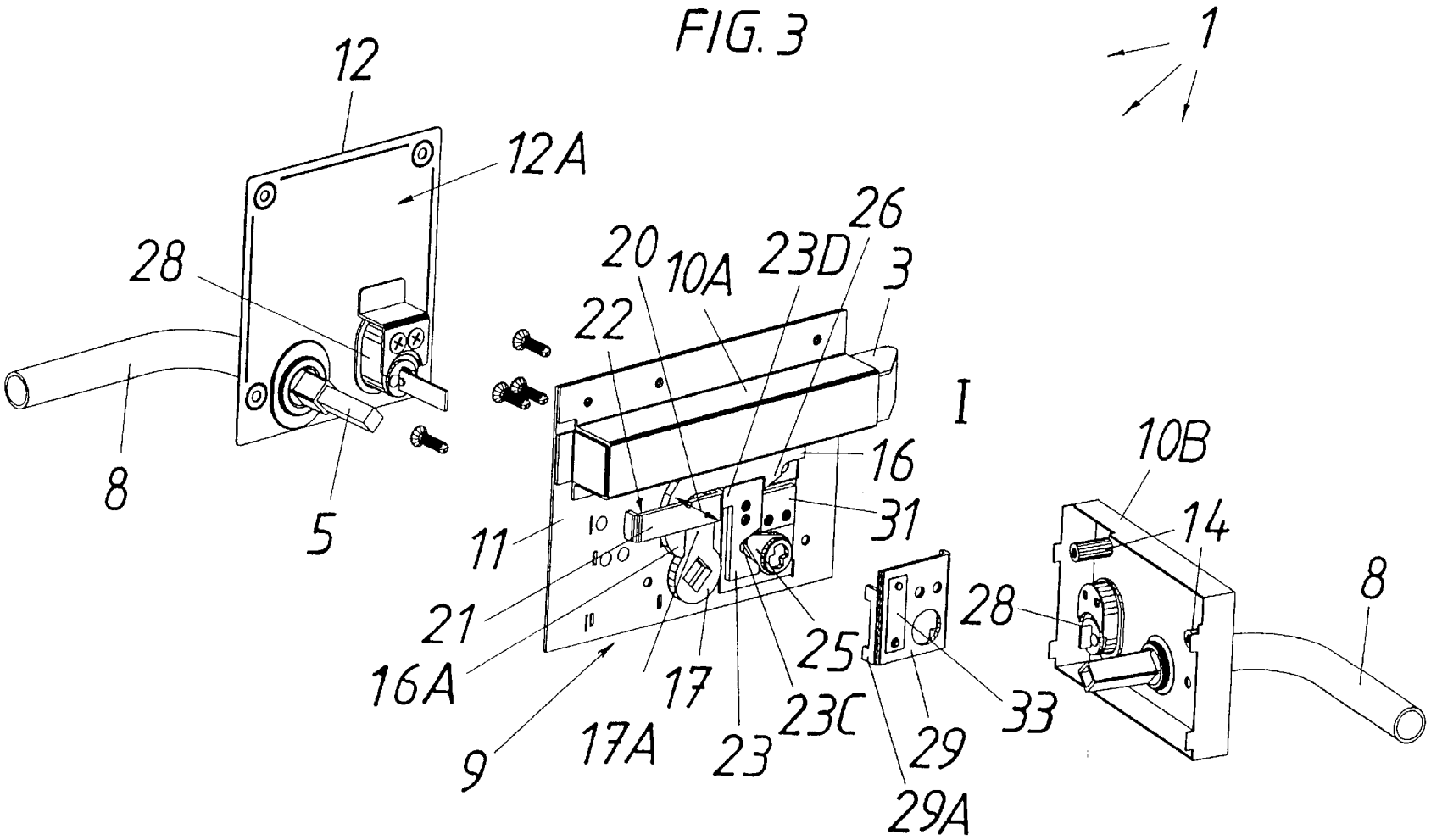
FIG. 3 shows the lock partially assembled.

Illustrated in FIG. 1 is a lock 1 in accordance with the invention comprising a lock bolt 3 spring-assisted in the intended direction 2 of locking, which is intended in the customary fashion to be displaced between an extended locking position I and a withdrawn opening position (not shown), by means of a handle connection 5 extending through an intended door 4 and a handle 8 projecting on either side 6, 7 of the door. As shown in FIG. 1, both the lock bolt 3 and the actual locking mechanism 9 are accommodated enclosed within a lock casing 10, consisting of a bolt-accommodating part 10A and a sleeve 10B covering the lock mechanism, which lock casing is in turn installed on a plate 11 capable of being installed along the inside 7 of a door 4. In a corresponding door fixing plate 12 on the outside 6 of the door, the bolts 13, etc., holding the lock 1 together preferably have their heads recessed into it so as to prevent forcing of the lock. It is also possible to execute the lock 1 in such a way that said bolts 13 are introduced from the inside 7 of the door, i.e. via the door fixing plate 12, and the ends of the screws are then secured to nut devices, etc., which, for example, have been welded or glued in place to the inside 12A of the plate 12 capable of being fixed to the outside 6 of the door 4. Nut devices 14 of this kind are shown in FIGS. 2 and 3 and are used for fixing the sleeve 10B to the door fixing plate 11.

Projecting laterally, for example downwards 15, from said lock bolt 3 is an actuating arm 16 that is rigidly attached to it. This is capable of actuation by means of a follower 17, which is non-pivotally attached to the aforementioned handle 8 and handle connection 5, and as such is also capable of pivoting with them. In conjunction with this pivoting motion S, a pressure component 17A in the follower 17 presses against a hook component 16A on the actuating arm 16, and the actuating arm and accordingly also the lock bolt 3 are pressed inwards 18 against the direction of locking 2 into the opening position, so that the door can be opened. As the force applied to the handle 8 is gradually removed, a pressure spring 19 arranged in the bolt accommodating part 10A of the lock casing pushes the lock bolt outwards in the direction of locking 2 and back into the locking position I. As an alternative, the spring 19 can also clearly be of the tension spring type, which draws the lock bolt in the direction of locking 2. The hook component 16A of the actuating arm 16 capable of being actuated by the follower 17 is preferably arranged at the outer end 16B of an angled part 16C of said arm.

A strap 21, which restricts the pivoting motion S of the follower for example to 45°, is provided in order to prevent the follower 17 from sliding out of engagement with the hook component 16A of the actuating arm, either to the side 20, if the contact surfaces 16D, 17B of the components attempt to slide out of engagement with one another, for example as a result of external force applied to the lock, or along the plane of the pivoting motion S of the follower, if the follower is exposed to the risk, as a consequence of excessive pivoting motion, of sliding out of engagement with the preferably straight hook component 16A of the actuating arm. This strap 21 is fixed to the door fixing plate 11 and encloses the pressure component 17A of the follower and the hook component 16A of the actuating arm, thereby forming a groove 22 in which the components are guided in a lateral sense 20, which groove also restricts the pivoting motion S of the follower 17 and thus also the common inward 18 and outward 2 movement of the actuating arm 16 and the bolt 3.

Provided for the purpose of locking the bolt 3 in the locking position I is a lock component 23 arranged so as to be capable of displacement and of being guided in a linear, vertical direction 24 by means of a pivotally V mounted lock component carrier 25 between a locking position I, which locks the actuating arm 16, in which the lock component 23 interacts with a stop 26 on said arm, and an opening position (not shown), which releases the actuating arm, in which the lock component 23 is drawn downwards out of engagement with said stop. This stop 26 on the actuating arm 16 is preferably arranged on the angled part 16C of said arm which exhibits the hook component 16A at its opposite end 16E to the hook component.

In accordance with a preferred embodiment the lock component comprises an upright 23, one side 23A of which exhibits a recess 23C in which a radially 27 projecting actuating component 25A of the lock component carrier 25 is accommodated in such a way as to guide said lock component 23, by means of a pivoting motion V, in a vertical sense 24 either into said locking position I, in which the lock component 23 interacts with the aforementioned stop 26 on the actuating arm, or into the opening position in which it is released from the actuating arm, in which the lock component 23 is drawn downwards out of engagement with said stop. Said pivoting motion V is obtained by means of one/several lock cylinder/s 28 of a previously disclosed kind, capable of being actuated by means of a key, attached to said lock component carrier 25 and attached to any side/sides 6,7 of the lock 1 and the door 4 in question.

Figures 4, 5:
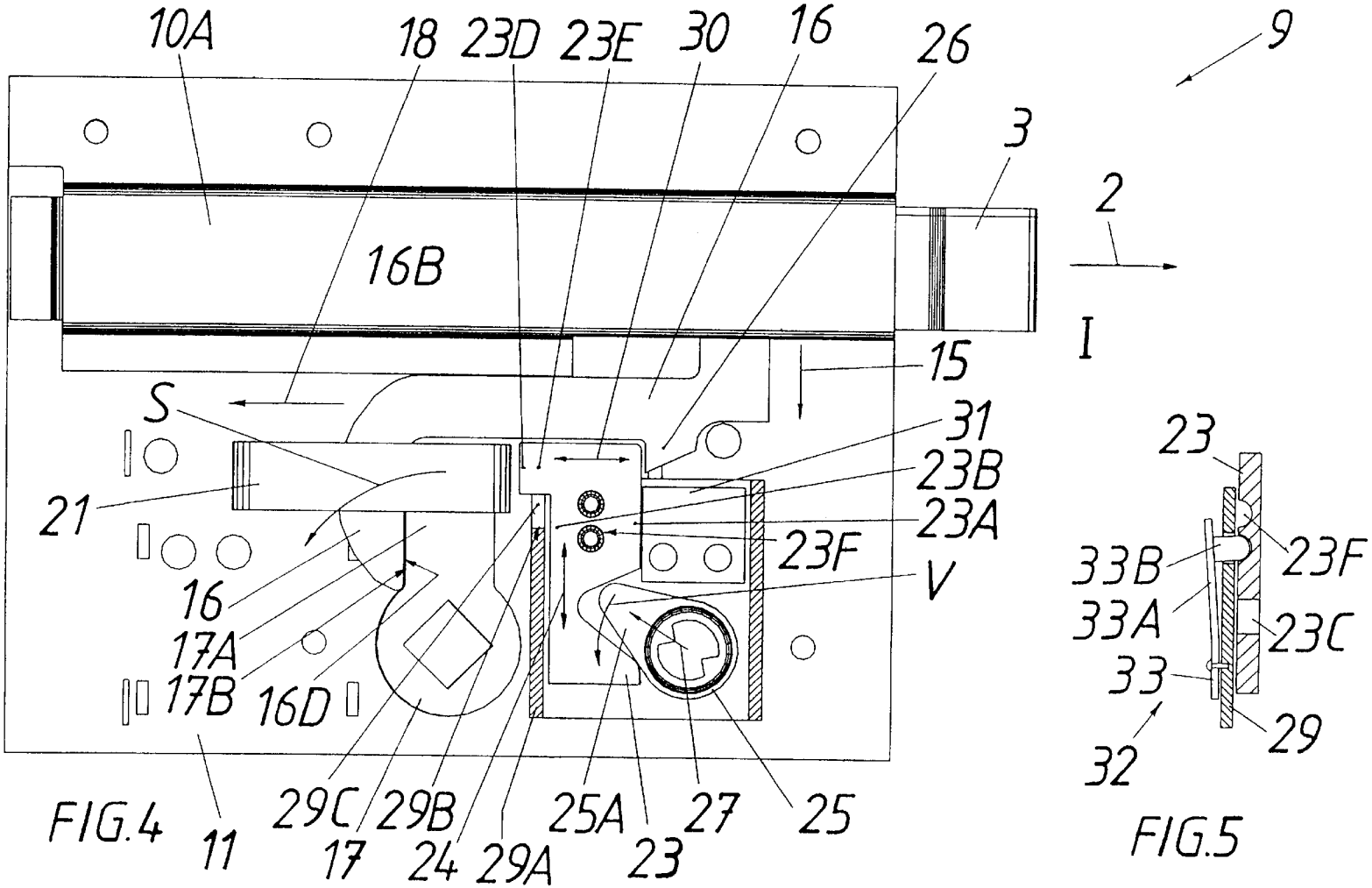
FIG. 4 shows the locking mechanism of the lock viewed from the front, partially sectioned.
FIG. 5 shows a sectioned view of a spring-assisted retaining mechanism included in the lock.

The lock component carrier and the lock component are also enclosed within a protective cover 29 attached to the door fixing plate 11, which cover is shown removed from the plate in FIG. 3. The lock component 23 is appropriately guided laterally along at least one end surface 29A of said protective cover 29 and is also retained against the door fixing plate 11 by that protective cover. The end positions for the movement of the lock component 23 in the vertical sense 24 are determined in the upper, so-called locking position I by the contact with the actuating arm 16, and in the lower, so-called opening position by the fact that a projecting part 23D of the locking component 23 engages with the bottom 29B of the slot 29C in the protective cover 29 into which it is introduced. As can be seen from FIG. 4, the upper part 23E of the locking component can also be guided in a lateral sense 30 with the projecting part 23D of the looking component in engagement with the aforementioned strap 21 and, if appropriate, with a supplementary engagement component 31 on the opposite side of the locking component.

A locking mechanism 32 comprising a spring-assisted stop component 33 is also arranged so as to interact with the locking component 23 for the purpose of retaining it in a position determined by the lock cylinder 28. The function of said stop component is illustrated separately in FIG. 5. In this case said spring-assisted stop component 33 comprises a spring-assisted tongue 33A which is secured to the protective cover 29, which tongue exhibits a pin 33B extending through an opening 29D in said protective cover 29, which pin is capable of being accommodated in a hole consisting of two matching holes 23F in the locking component 23 located at a distance from one another for the purpose of retaining the locking component in a raised or lowered position. The end of the pin is preferably spherically rounded, and said holes in the locking component in this case exhibit a depth and a form corresponding to the rounding.

The function and the applicability of the invention should have been appreciated from the foregoing and from the aforementioned drawings in which an example of the invention is illustrated. The invention is not restricted to the illustrative embodiment described above and shown in the drawings, but may be varied within the scope of the patent claims without departing from the idea of invention.

What is claimed is:

1. In a locking mechanism for a door having an inside and an outside face, a plate attached to the inside face of the door, a casing for enclosing a spring-assisted lock bolt having an actuating arm attached thereto, said actuating arm having a downwardly depending hook component on one arm end and a stop on an opposite end, a handle connection for moving said actuation arm, said handle connection extending through said door and including a respective handle attached thereto from each door side, a follower received on said handle connection for actuating the actuating arm and lock bolt when either of said handles are turned, a lock component vertically displaceable by a lock component carrier, which said lock component carrier is attached to a lock cylinder disposed on each side of said door, said lock cylinder rotatably movable by operation of a key, said lock component movable between a locking position wherein said actuating arm is locked, and an opening position wherein said lock component is released from a stop on said actuating arm, a spring-assisted stop component for retaining said lock component in the opening position and in said locking position, the improvement comprising:

a locking arrangement for locking said bolt, comprising a projecting pressure component formed on said follower and a downwardly depending hook component formed on one end of said actuating arm and stop on an opposite end thereof, said hook in contact with said projecting pressure component of said follower, a strap attached to said plate for enclosing said hook and said follower, a lock component disposed between said strap and said stop, and a lock component carrier having an actuating component projecting therefrom, said actuating component rotationally movable by rotational movement of said lock cylinder, wherein movement of said actuating component vertically displaces said lock component such that when said actuating component is disposed between said stop and said strap, said lock bolt is in said locking position, said lock component and lock component carrier enclosed within a protective cover attached to said plate, said cover having an end surface for guiding said lock component.

2. The arrangement as claimed in claim 1, wherein a stop component comprises a spring-assisted tongue secured to the protective cover, said stop component having a pin which extends through an opening in the protective cover, which said pin is accommodated in matching holes formed in the locking component.

* * * * *